United States Patent [19]

Romanos

[11] Patent Number: 4,802,593

[45] Date of Patent: Feb. 7, 1989

[54] FLEXIBLE DESKTOP ORGANIZER

[76] Inventor: Nayla J. Romanos, 4201 Cathedral Ave., N.W. Apt. 819 E, Washington, D.C. 20016

[21] Appl. No.: 73,232

[22] Filed: Jul. 14, 1987

[51] Int. Cl.[4] ..... B42F 17/00

[52] U.S. Cl. ..... 211/10; 211/189

[58] Field of Search ..... 211/10, 194, 189, 71, 211/11, 74, 88; 273/282 C, 282 R; 220/23.83; 206/214, 224, 371, 563, 514

[56] References Cited

U.S. PATENT DOCUMENTS

| | | | |
|---|---|---|---|
| 1,637,922 | 8/1927 | Sullivan | 273/282 C |
| 3,520,537 | 7/1970 | Peebles | 273/282 C |
| 3,531,122 | 9/1970 | Peebles | 273/282 C |
| 4,176,743 | 12/1979 | Fitzpatrick | 211/69.5 X |
| 4,239,230 | 12/1980 | Shoptaugh | 273/282 C X |
| 4,472,843 | 9/1984 | Chermak | 211/42 X |

*Primary Examiner*—Reinaldo P. Machado
*Assistant Examiner*—Sarah A. Lechok Eley
*Attorney, Agent, or Firm*—Sughrue, Mion, Zinn, Macpeak and Seas

[57] ABSTRACT

A flexible desk top organizer comprising:

a gridded planar base having a plurality of openings therein;

the openings being of substantially the same configuration and comprising substantially the same shape;

a plurality of functional modules capable of being located in various positions on the base;

the modules containing protrusions on the bottom portions thereof;

the protrusions being of substantially the same configuration as the openings, but being adapted so as to fit within the openings in the gridded base;

the protrusions being of sufficient length in a vertical plane to effectively hold the modules in desired locations on the base; and the modules being adapted to function as containers for a variety of desk implements or serving other functions.

The flexible desktop organizer has a simple structural design, allows for maximum flexibility in the organization of desk implements in the office environment, is adaptable to office worker's individual tastes, and thus promotes efficiency while at the same time creating an aesthetically pleasing utilitarian tool.

6 Claims, 2 Drawing Sheets

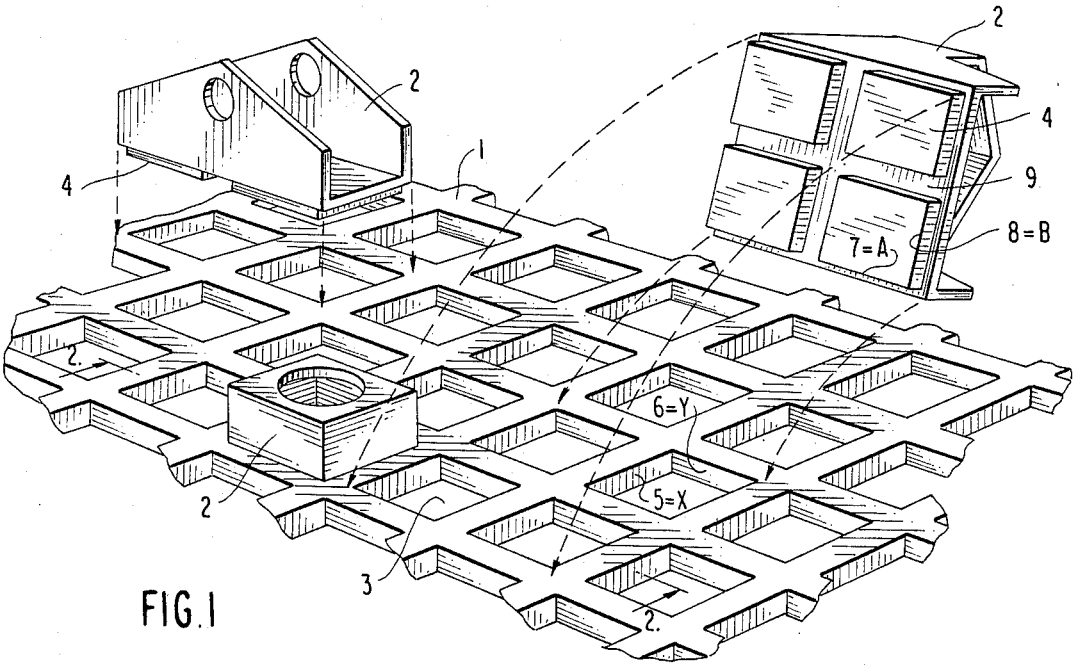
FIG.1
FIG.2
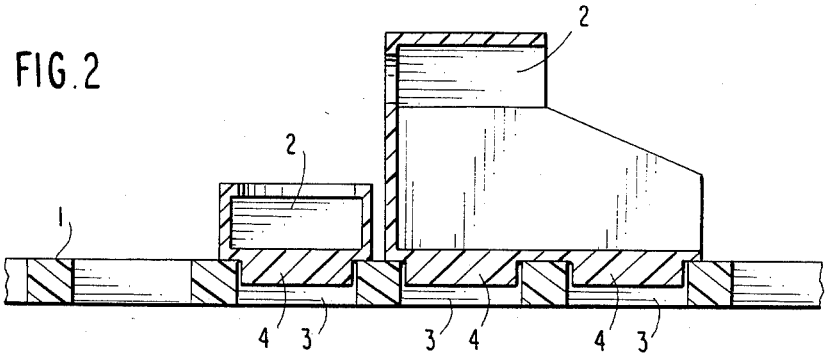
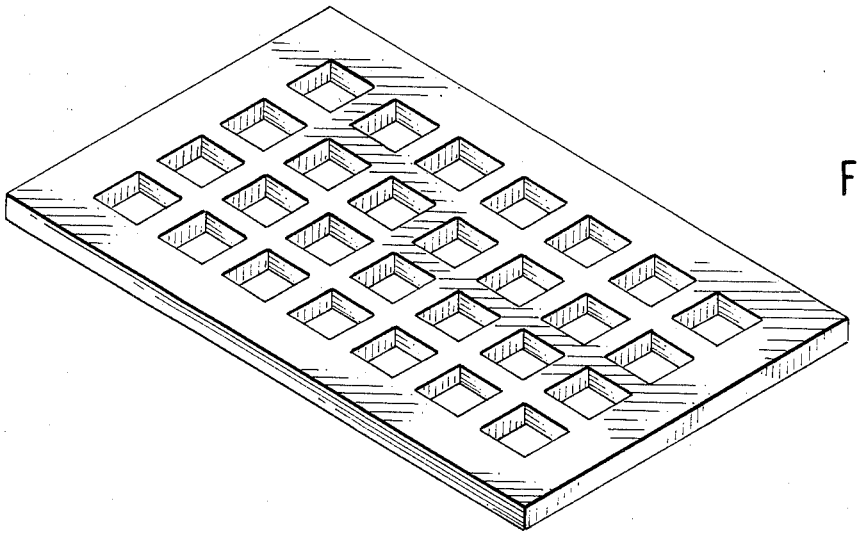
FIG.3

FLEXIBLE DESKTOP ORGANIZER

FIELD OF THE INVENTION

The present invention is directed to an improved system for organizing conventional desk supplies used by individual office personnel.

BACKGROUND OF THE INVENTION

Pens, pencils, memo pads, papers, documents and envelopes, clips, scissors, business cards and many other office accessories are a "must" in a business office environment, but usually clutter up even the tidiest office desks. Placing such accessories in a drawer may allow one to present a neat desktop, but has certain drawbacks, including a loss of efficiency of the office worker who must waste time opening and searching through drawers when, e,g., a simple paper clip is needed. From a viewpoint of promoting office efficiency, such accessories should be within easy reach, but simply placing them on a desktop might not be very aesthetical or tidy.

Attempts have been made to design individual containers for specific desktop items, enabling the office worker to choose the items needed, but the presence of such various forms of office accessory holders on the same desk at the same time contributes to clutter, which is undesirable both from a visual perspective as well as from that of working efficiency. Thus, more compact solutions have been proposed, such as single compartmented containers (as illustrated in, e.g., U.S. Pat. No. 4,475,022), where a number of specific items are combined within one type of structural container. Such containers may improve desk organization in general, but have the major disadvantage of imposing a specific combination of office items on the office worker.

Another attempt at solving this problem is depicted in U.S. Pat. No. 4,403,700 which describes a holder that forms a trackway for a plurality of individual modules positionable therein, and slideable along its length (therefore in one direction only). This holder track is provided in standard fixed length, thus corresponding to a fixed number of modules. Further, this patent requires a number of dividers between the modules, as well as elaborate attachment means, such as brackets, clips, etc,, for holding the accessories along the length of the holder track. Thus, besides the very principle of a linear track, where modules are placed one next to the other, such a configuration presents the disadvantage of being unaesthetical in addition to being of limited practicality and efficiency. Thus, it is easily seen that the modular office accessory depicted in this patent is of somewhat limited practical utility, offers very limited flexibility and is complicated to manufacture and produce.

Organization of desk supplies is an area where due to the drawbacks inherent in previous attempts at creating an organized, efficient and aesthetically pleasing working environment, there is much room for innovation and improvement from both visual and practical points of view.

SUMMARY OF THE INVENTION

The present invention has been accomplished to overcome the foregoing disadvantages of conventional attempts at organizing desk accessories, and provides an efficient, practical system for desktop organization, while at the same time presenting an aesthetically pleasing structure to the office environment.

Accordingly, one object of the present invention is to provide a flexible desktop organizer which allows the office worker to choose and organize desk implements in a convenient and efficient manner, and further gives him the possibility of further expansion, i.e. adding new modules as the need arises.

Another object of the present invention is to provide a flexible desktop organizer wherein desk accessories can be located therein in a flexible fashion permitting the office worker to organize his desk accessories according to personal tastes, as well as according to the frequency of use of specific accessories, thus desirably promoting efficiency in the office environment.

A still further object of the present invention is to provide a flexible desktop organizer which is of relatively simple structural design, thus avoiding complicated manufacturing and production steps.

These and other objects of the present invention are satisfied by a flexible desktop organizer, comprising.

a gridded planar base having a plurality of openings therein;

the openings being of substantially the same configuration and comprising substantially the same shape;

a plurality of functional modules capable of being located in various positions on the base;

the modules containing protrusions on the bottom portions thereof:

the protrusions being of substantially the same configuration as the openings but being adapted so as to fit within the openings in the gridded base;

the protrusions being of sufficient length in a vertical plane to effectively hold the modules in desired locations on the base; and the modules being adapted to function as containers for a variety of desk implements or serving other functions.

The present invention is described in detail hereafter, with reference to the accompanying drawings and preferred embodiments thereof, which are not to be construed as limiting the scope of the present invention.

BRIEF DESCRIPTION OF THE DRAWINGS

FIG. 1 represents an isometric view of a preferred form of the invention illustrating one manner in which the individual accessories are located and placed in the desired openings in the gridded base.

FIG. 2 is a cross-sectional view of a preferred form of the invention illustrating a further detailed view of the fitting system.

FIG. 3 is an isometric view of the preferred gridded base having seven rows and four columns of openings, suitable for use with modules having square-shaped fitting protrusions extending from the bottoms thereof.

DETAILED DESCRIPTION OF THE INVENTION

Figure 4:
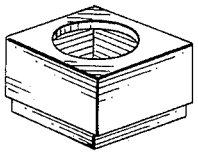
FIG. 4 is an isometric view of an accessory useful for containing clips.

In a preferred embodiment, as described in detail herein, the present invention includes a gridded planar base having a plurality of openings of substantially the same configuration and substantially the same area. The openings are provided to extend through the whole depth of the base. In this manner, the base may be freely posed on a desk on either side (top or bottom). In the illustrative drawings of the present invention, the openings are square-shaped (see. e.g.. FIG. 3). but it will be understood that the base could contain openings having other simple geometric shapes.

The preferred material for the gridded base is wood or plexiglass, but other materials, such as various plastics, etc., can also be used.

The planar base used as the support is capable of holding a plurality of individual containers for office supplies. These containers, referred to hereinafter as "modules", are specially designed so that the bottom portions thereof comprise protrusions which fit into the openings in the base. Thus, each protrusion is seen to be of substantially the same configuration as the openings in the gridded base while its area will be slightly less than that of the opening, thus allowing a convenient fit therein. The protrusion should be of sufficient length in a vertical plane to effectively hold each module in place on the base (and at the same time less than the base thickness). For example, FIG. 2 illustrates an embodiment wherein the protrusions (4) extending from the bottom portions of each module (2) extend approximately half-way into the openings (3) in the gridded planar base (1). Also, each module is constructed so that the surface area of the bottom portion (9) of each module which does not comprise the protrusion(s) extending therefrom is of a large enough dimensional area to allow the modules to conveniently rest on the top planar surface of the base while the protrusions extend into the openings thereof. Further, it will be understood that some of the modules will contain one protrusion (such as the modules illustrated in FIGS. 4–8), while others may contain two protrusions (see. e.g., FIG. 9), while still others may contain four protrusions such as the relatively larger accessory containers illustrated in FIG. 10 (an envelope and paper holder). FIG. 11 (a memo pad holder), or FIG. 12 (a memo pad/cigarette box and lighter holder).

As noted, the protrusions (4) extending from the bottom portions of the modules should extend deep enough into the openings to effectively hold the modules in place, but are preferred to be shorter than the vertical depth of the openings in the base.

The modules are preferably made of the same material as the base, i.e., wood or plexiglass, but it will be understood that, as with the base itself, a wide variety of other materials could also be used to make the modules.

In a preferred embodiment of the present invention, the gridded planar base illustrated in FIG. 3 contains openings which are arranged according to two sets of perpendicular axes are equally spaced, thus creating a regular grid pattern. In FIG. 3, the individual openings are square-shaped, but as mentioned above, the openings could comprise other geometric shapes (such as triangles, circles or other shapes). In FIG. 3, the gridded base exhibits four rows and seven columns of openings, but it will also be understood that the size of the entire base and the number of openings contained therein can be modified to adapt to different desk sizes, etc.

The containers or modules are individually designed depending on their end use. Further, while the shapes and sizes of the modules may differ from each other each module functions in accordance with the present invention in the same manner. i.e., by containing one or more protrusions extending from the bottom thereof which allow a convenient fit within the openings on the gridded planar base. In this fashion, the office worker can organize his desk implements and accessories in any desired manner, contributing to and promoting neatness organization and thus, office efficiency.

In a preferred embodiment of the present invention, each module, while being of a different size and shape, and serving varying functions due to such differences, employs the same basic design and uses the same materials and matching colors to create an aesthetically pleasing overall structure. The modules form a homogeneous set wherein the relative proportions of each have been carefully selected, and the recurring shapes provide a sense of unity to the structure as a whole in such a way that the combination of modules allows the office worker to create a wide variety of attractive and practical sculptural compositions. In the preferred form of the invention, circular openings and oblique lines in the modules are illustrative of such recurring shapes and features, but other shapes and features could also be used.

The flexible desktop organizer in accordance with the present invention responds to the needs of office personnel by providing a single point of control for the organization of desk accessories customarily used by office workers. The office worker can select the proper accessories suitable to his own needs, and as such needs evolve over time due to. e.g.. changing projects, etc.. (more or less) accessories could be added to (or subtracted from) the gridded planar support at any time. This allows maximum flexibility depending not only on the office worker's personal tastes, but also on his changing needs for desk implements and accessories.

Further, the planar configuration of the base allows the accommodation and easy access of a large number of modules or containers within a relatively compact surface area. Such a support base also offers the possibility of multi-sided utilization thereof in the case of juxtaposed desks in, e.g., "open planned offices", and gives depth to an otherwise dull alignment of accessories, thus creating an interesting sculptural composition from any angle. Moreover, the very flexibility of the desktop organizer allows the office worker the opportunity to create his own personal, functional and sculptural composition which adapts not only to his own needs, but also to his tastes and personal preferences. So, out of the variety of harmoniously designed shapes and colors and the tremendous number of potential combinations, each office worker can create his own functional desktop organizer by marrying volumes and voids, shapes and colors, transcending a necessary utilitarian tool into a highly personalized dynamic sculpture.

The accompanying drawings illustrative of one embodiment of the present invention will be described in detail hereinbelow.

FIG. 1 represents a preferred form of the present invention showing the fitting system between the protrusions (4) extending from the bottom portions of the modules and the gridded planar base (1). As shown, each module (2) contains at least one protrusion (4) extending from the bottom portion thereof which is adapted to fit within an opening (3) in the gridded base (1). In this embodiment, the protrusions (4) and the openings (3) are of substantially the same configuration, i.e., square-shaped. Further, the area of the openings (3) can be measured by XY where (5)=X and (6)=Y. If the area of the bottom portion of a protrusion (4) is measured by AB, where (7)=A and (8)=B. it will be understood that the area defined by AB should be just slightly less than the area defined by XY. This allows the protrusions extending from the modules to form a convenient fit within each of the openings thus holding the modules in a relatively firm position on the base. Also, the bottom portions (9) of the modules which do not comprise the protrusions should be a flat surface which would rest on the planar surface of the gridded base when in place.

FIG. 2 is a cross-sectional view of the gridded planar base (1) showing two modules (2) having their protrusions (4) fitted within the openings (3).

FIG. 3 represents an isometric view showing a preferred embodiment of the gridded planar base containing four columns and seven rows of square-shaped openings positioned along two perpendicular axes. Of course, as noted above, the base is not limited to square shaped openings, nor are the protrusions extending from the bottom of the modules limited to square-shaped areas adapted to fit therein. Also, the number of rows and columns of openings is not limited to seven and four respectively, but could have any other value.

Further, while the present invention is illustrated below with reference to accompanying FIGS. 4–13 describing examples of modules suitable for use in the flexible desktop organizer according to to the present invention, it will be understood that various adaptations can be made to these modules, and other modules (not shown) can also be used, as long as they are capable of functioning as a container for desk accessories, or serving other useful purposes in the office environment (e.g., as a tape dispenser, a stapler, etc.).

FIG. 4 represents an isometric view of an accessory or module useful for containing paper clips, pins, or any other useful office item of a comparable size. This accessory has a shallow empty box-like structure comprising a top portion which contains a relatively large circular opening, four rectangularly shaped vertical sidewalls and a bottom portion having one square-shaped protrusion.

Figure 5:
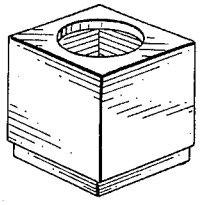
FIG. 5 is an isometric view of an accessory useful for containing an eraser pencil lead, magic markers or anything of the sort.

FIG. 5 represents an isometric view of an accessory suitable for holding pencil leads, erasers, magic markers, or other office items of comparable size. This accessory is similar in construction to that shown in FIG. 4, differing only in the sidewall proportions. i.e.. the four vertical sidewalls are of a larger surface area, resulting in a module comprising a larger inner volume than the module shown in FIG. 4.

Figure 6:
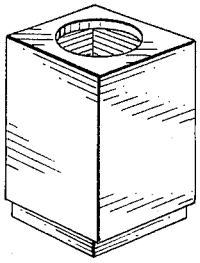
FIG. 6 is an isometric view of an accessory useful for containing pens and pencils.

Similarly. FIG. 6 is an isometric view of an accessory useful for containing pens or pencils or other office items of comparable size, and is similar in construction to the modules illustrated in FIGS. 4 and 5, but having sidewalls of a larger surface area, and thus containing an even larger inner volume than the modules shown in FIGS. 4 and 5.

Figure 7:
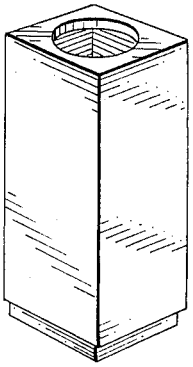
FIG. 7 is an isometric view of an accessory useful for containing scissors, long pens, "coupe papier" or other items.

Likewise. FIG. 7 represents an isometric view of a module useful for containing e.g.. scissors, exactos, long pencils or other office items of comparable sizes, and is of basically the same design as the modules illustrated in FIGS. 4, 5, and 6, but having vertical sidewalls of a larger surface area, thus being of a larger inner volume than the module illustrated in FIG. 6.

Figure 8:
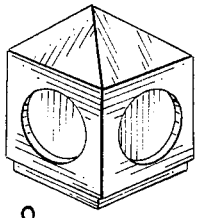
FIG. 8 is an isometric view of an accessory useful as a paperweight.

FIG. 8 represents an isometric view of an accessory serving as a paperweight. This module comprises a pyramidal roof shape covering a full box, the four sides of which are carved with shallow cylindrical depressions. These depressions serve the dual purpose of facilitating the handling of the paperweight as well as contributing to a recurrent feature of the modules. i.e., corresponding to the circular openings in the modules illustrated in FIGS. 4–7, as well as the circular openings in the various sidewalls in the modules illustrated in FIGS. 9–12, described hereafter.

Figure 9:
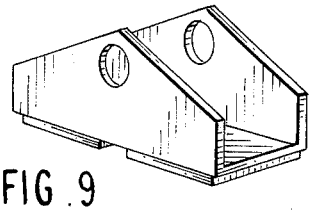
FIG. 9 is an isometric view of an accessory useful for holding business cards.

FIG. 9 represents an isometric view of a module useful for holding business cards or the like, and comprising a planar bottom portion having two protrusions extending therefrom, and two parallel vertical sidewalls pierced with circular openings, adapted so that the business cards may be placed therebetween, yet allowing easy removal thereof. The circular openings facilitate easy handling and positioning of the module in the desired location on the gridded base, thus contributing to the overall flexibility of the present invention.

Figure 10:
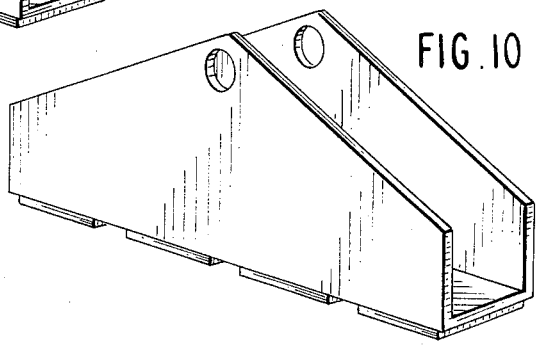
FIG. 10 is an isometric view of an accessory useful for holding papers or envelopes.
Figure 11:
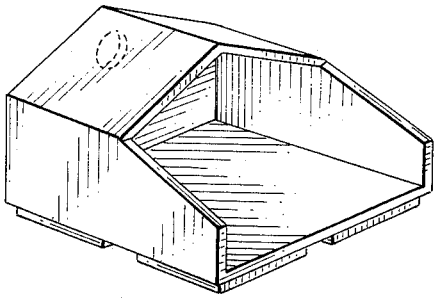
FIG. 11 is an isometric view of an accessory useful for holding a memo pad.

FIG. 10 represents an isometric view of an accessory useful for holding envelopes or documents, as well as cards of comparable sizes. Its overall design is similar to that of the business card holder accessory shown in FIG. 9, but with larger proportions. This accessory is seen to comprise four protrusions extending from the bottom portion thereof, also having a horizontally planar base portion and two vertically parallel sidewalls of similar shape to the business card holder. The sidewalls also contain circular openings near the top portions thereof for facilitation of handling.

FIG. 11 represents an isometric view of an accessory used to contain a memo pad. The module contains four protrusions extending from the bottom portion thereof, and also comprises a horizontally planar base portion, two vertically parallel sidewalls having the shapes illustrated in FIG. 11, as well as a rearwall containing a circular opening therein to facilitate handling. Further, a roof structure is provided as shown. extending between rear portions of each vertical sidewall and interconnected with each sidewall and the upper portion of the rearwall.

Figure 12:
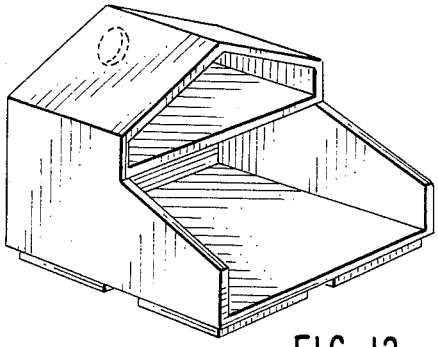
FIG. 12 is an isometric view of an accessory useful for holding a memo pad, and a small pencil or a cigarette box and a lighter.

FIG. 12 is similar in design to the memo pad holder illustrated in FIG. 11, but contains an additional upper horizontal shelf parallel with the planar base portion suitable for holding cigarette lighters, small pencils, or other items. Further, the sidewalls extend longer in a vertical plane than those illustrated in FIG. 11, to allow for an inner volume to be created between the area defined by the upper shelf and the roof structure, as illustrated in FIG. 12.

Figure 13:
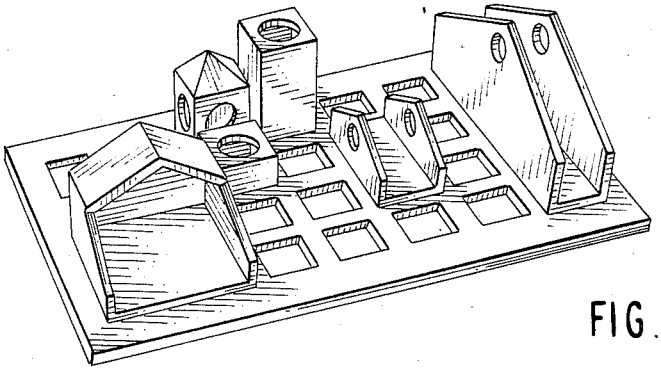
FIG. 13 is an isometric view of one of many possible combinations of modules/containers illustrated by FIGS. 4–12 located in a gridded base (as in FIG. 3) having square-shaped openings wherein the modules have square-shaped protrusions on the bottoms thereof adapted so as to allow the protrusions to fit within the square-shaped openings in the base; the specific accessories illustrated in this embodiment are a memo holder, a paperweight, a business card holder, an envelope holder, a clips box and a pencil box.

FIG. 13 represents an isometric view of one of the many possible combinations of a flexible desktop organizer in accordance with the present invention. Illustrated are a gridded planar base having seven rows and four columns of square-shaped openings therein and six modules corresponding to the memo pad holder as in FIG. 11, a paperweight as in FIG. 8, a business card holder as in FIG. 9, a paper clip box as in FIG. 4, a pencil box as in FIG. 6 and an envelope/document holder as in FIG. 10. In practice, each of these accessories should be made of the same material and be of matching colors. It will be understood that the arrangement of these modules on the base is extremely flexible, and that many other structural compostions could be obtained by locating the various modules in different places on the gridded planar base. Thus, each office worker is provided with the opportunity to create a practical and aesthetic composition suitable to his own personal tastes with the appropriate combination of accessories convenient to him. Moreover, further accessories could be added to (or subtracted from) the structure at any time depending on job or project requirements while the same combination would be arranged to simply fit the office worker's need or mood of the day. In brief, the flexible desk organizer in accordance with the present invention provides the office worker with a single point of functional control, and eliminates desk clutter, at the same time transcending a necessary utilitarian tool into a highly personalized dynamic sculpture.

While the present invention has been described in detail above, with reference to specific embodiments thereof as illustrated in the accompanying drawings, it will be understood by those of ordinary skill in the art that reasonable modifications as to the scope of the present invention can be made without departing from the spirit and scope thereof.

What is claimed is:

1. As an article of manufacture, a desktop organizer comprising, in combination:

a gridded planar base having a plurality of openings therein;

said openings being of substantially the same configuration and comprising substantially the same shape;

a plurality of functional modules capable of being located in various positions on said base;

said modules containing one or more protrusions on the bottom portions thereof;

said protrusions being of substantially the same configuration as said openings, but being adapted so as to fit within one or more of said openings in said gridded base;

said protrusions being of sufficient length in a vertical plane to effectively hold said modules in desired locations on said base; and said modules being adapted to function as containers for a variety of desk implements or serving other office functions, said plurality of functional modules comprising one or more of (a) a series of cross-sectionally square-shape modules formed of four sidewalls having the same surface area, a bottom portion containing said protrusion, and a top portion having an opening therein, each of said modules being adapted to have a hollow inside portion and to function as a container for various desk accessories based on the height of said modules;

(b) a module adapted to function as a paperweight by forming a solid square-shaped block having a pyramid-shaped top portion and a bottom portion containing said protrusion;

(c) a series of modules adapted to hold business cards, envelopes, documents or similar desk accessories comprising a bottom portion containing at least two of said protrusions, and two similarly-shaped sidewalls rising vertically from opposite peripheral edges of said bottom portion to form a holding space therebetween; and (d) a series of modules adapted to form a partially enclosed holding section comprising a bottom portion containing four of said protrusions, three sidewalls and a top portion comprising two similarly-shaped roof pieces adapted to form an upwardly inclined roof-like structure, each of the sidewalls and roof pieces being shaped to integrally form said partially enclosed holding section for holding memo pads, cigarettes or other desk accessories, and said modules may further comprise a piece adapted to form a shelf parallel with said bottom portion and extended between two opposing sidewalls below said upwardly inclined roof like structure.

2. A desktop organizer as claimed in claim 1, wherein said gridded, planar base is rectangularly-shaped, and said openings therein are square-shaped.

3. A desktop organizer as claimed in claim 1, wherein said protrusions are square-shaped.

4. A desktop organizer as claimed in claim 2, wherein said gridded planar base contains 28 openings therein arranged along two perpendicular axes in seven rows and four columns.

5. A desktop organizer as claimed in claim 1, wherein said base and said modules comprise wood or plexiglass.

6. A desktop organizer as claimed in claim 4, wherein said modules are are positionable along each of said perpendicular axes of openings.

* * * * *